United States Patent [19]

Lundstrom et al.

[11] Patent Number: 4,862,127

[45] Date of Patent: Aug. 29, 1989

[54] SOLENOID SHOCK ABSORBING BUMPER ARRANGEMENT AND METHOD

[75] Inventors: Robert W. Lundstrom, Plymouth; Thomas R. Emmons, Minneapolis, both of Minn.

[73] Assignee: DataCard Corporation, Minnetonka, Minn.

[21] Appl. No.: 276,355

[22] Filed: Nov. 23, 1988

[51] Int. Cl.[4] ..... H01F 7/08

[52] U.S. Cl. ..... 335/257; 335/271; 335/277

[58] Field of Search ..... 335/251, 255, 261, 257, 335/271, 277

[56] References Cited

U.S. PATENT DOCUMENTS

| | | | |
|---|---|---|---|
| Re. 21,497 | 6/1940 | Trombetta | 335/277 |
| 1,028,385 | 6/1912 | Price | 335/257 |
| 2,311,890 | 2/1943 | Trombetta | 335/257 |
| 2,326,603 | 8/1943 | Barish | 101/3.1 |
| 2,544,491 | 3/1951 | Davis | 335/257 |
| 2,665,397 | 1/1954 | Jencks | 335/257 |
| 2,858,633 | 11/1958 | Kane | 101/27 |
| 3,134,932 | 5/1964 | Ray | 335/257 |
| 3,202,244 | 8/1965 | Vogelsong et al. | 335/277 X |
| 3,400,351 | 9/1968 | Flentge | 335/257 |
| 3,501,724 | 3/1970 | Westphal | 335/248 |
| 3,548,352 | 12/1970 | Sandoval | 335/265 |
| 4,236,132 | 1/1980 | Zissimopoulos | 335/271 |
| 4,381,491 | 4/1983 | Vogelgesang | 335/257 |
| 4,552,064 | 1/1985 | Sanders, Jr. et al. | 101/93.05 |
| 4,625,194 | 11/1986 | Held | 335/271 |

FOREIGN PATENT DOCUMENTS

| | | | |
|---|---|---|---|
| 2707078 | 9/1977 | Fed. Rep. of Germany | 335/257 |

*Primary Examiner*—George Harris

*Attorney, Agent, or Firm*—Merchant, Gould, Smith, Edell, Welter & Schmidt

[57] ABSTRACT

A solenoid bumper mechanism wherein a resilient means absorbs a proportion of the kinetic energy of a shaft moving within the solenoid, and a nonresilient means which causes the shaft to terminate its movement at a fixed point. The mechanism provides shaft movement of repeatable precise distances and also does not interfere with the magnetic field created by the solenoid body.

12 Claims, 4 Drawing Sheets

SOLENOID SHOCK ABSORBING BUMPER ARRANGEMENT AND METHOD

TECHNICAL FIELD

This invention relates to an energy-absorbing bumper arrangement used with a solenoid for reducing the energy of a solenoid lunger which impacts the bumper arrangement. In particular, the invention has particular use with solenoids used for embossing items such as plastic cards.

BACKGROUND OF THE INVENTION

A solenoid typically comprises a body comprised of steel which has wire wrapped around the body in a coiled fashion. The body has an aperture with a plunger located in a slidable fashion in the aperture. An electric current is applied to the coil which creates a magnetic field. As the current is applied, the plunger is caused to slide in the aperture due to the magnetic field created by the coil. As the plunger moves into the body, an air gap in the aperture is filled. As the air gap is filled, the spacial gap between the lines of the magnetic field diminishes which in turn increases the strength of the field. Therefore, as the plunger moves into the body, its velocity tends to increase due to an enhanced magnetic field. Because of the high velocity of the plunger, a solenoid system may be damaged by the repeated impact of the high speed plunger. Moreover, the impact of the plunger against the body of the solenoid creates a rather loud noise.

Compressible pads or springs have been used in an attempt to absorb some of the energy of the plunger. As the plunger moves inwardly toward the solenoid body, abutments extending from the plunger or body impact the pads or springs. The impact causes the pads or springs to compress and eventually stop the plunger. U.S. Pat. No. 2,311,890 is representative of this system. However, a problem encountered with the pad or spring systems is a lack of precision in the travel distance of the plunger. This is particularly true of solenoids used in embossing. As the plunger impacts the pad or spring, its precise point of stopping will vary according to the force applied by the plunger during the embossing process since different characters require different embossing forces. Also, the age of the spring or pad or climatic conditions affect the elastic properties of the pad. Moreover, as the springs or pads deteriorate, the resistive force afforded by the springs or pads tends to lessen and thus allows the plunger to travel further into the core.

Another problem encountered with the use of pads or springs is that their placement in the magnetic gap may require increasing the magnetic gap thereby decreasing the force of the solenoid. In addition, the additional iron or metal of the abutments or springs may create interference in the magnetic field. This interference in the magnetic field results in a lack of precision in the travel distance of the plunger. The present invention solves these and other problems associated with the prior art.

SUMMARY OF THE INVENTION

The present invention relates to an energy-absorbing bumper arrangement to be used with a solenoid. The arrangement has a solenoid body and a plunger coaxially movable therein. The plunger comprises a head portion and a shaft portion wherein the shaft portion is slidably engaged in an aperture of the solenoid body.

The bumper arrangement has a resilient and a substantially nonresilient stop means which provides for a stopping movement of the plunger at a repeatable, predetermined location. As the plunger strikes the resilient stop means, the energy-absorbing means provides less resistance than required to stop the movement of the plunger and thus the plunger is allowed to strike a nonresilient fixed stop means, thus creating a repeatable, predetermined stop location. The energy-absorbing means is a resilient member and is removed from the magnetic path created by the solenoid body.

In the preferred embodiment of the invention, the bumper arrangement comprises a first end of the solenoid body which faces a plunger head and includes a resilient member mounted on the side of the solenoid body outside of the magnetic gap so as to not increase the effective magnetic gap and projects beyond the first end of the solenoid toward the plunger head portion. The resilient member is molded from a damped thermoplastic which is highly resistant to deformation at high impact speeds and less resistant to deformation at slow impact speeds.

The present invention has particular utility with commonly assigned Ser. No. 204,499, filed June 9, 1988, which is hereby incorporated by reference.

These and various other advantages and features of novelty which characterize the present invention are pointed out with particularity in the claims annexed hereto and forming a part hereof. However, for a better understanding of the invention, its advantages and objects obtained by its use, reference should be made to the drawings which form a further part hereof, and to the accompanying descriptive matter in which there is illustrated and described a preferred embodiment of the invention.

BRIEF DESCRIPTION OF THE DRAWINGS

In the drawings wherein corresponding parts are generally referred by like reference numerals.

DETAILED DESCRIPTION OF A PREFERRED EMBODIMENT OF THE INVENTION

Figure 1:
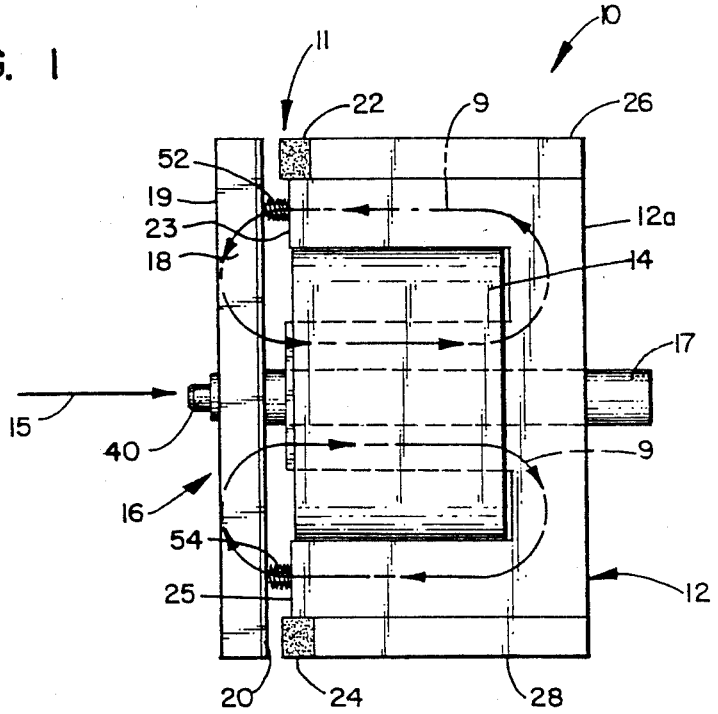
FIG. 1 is a diagrammatic top view of an embodiment of a solenoid using an embodiment of a bumper arrangement in accordance with the principles of the present invention.
Figure 2:
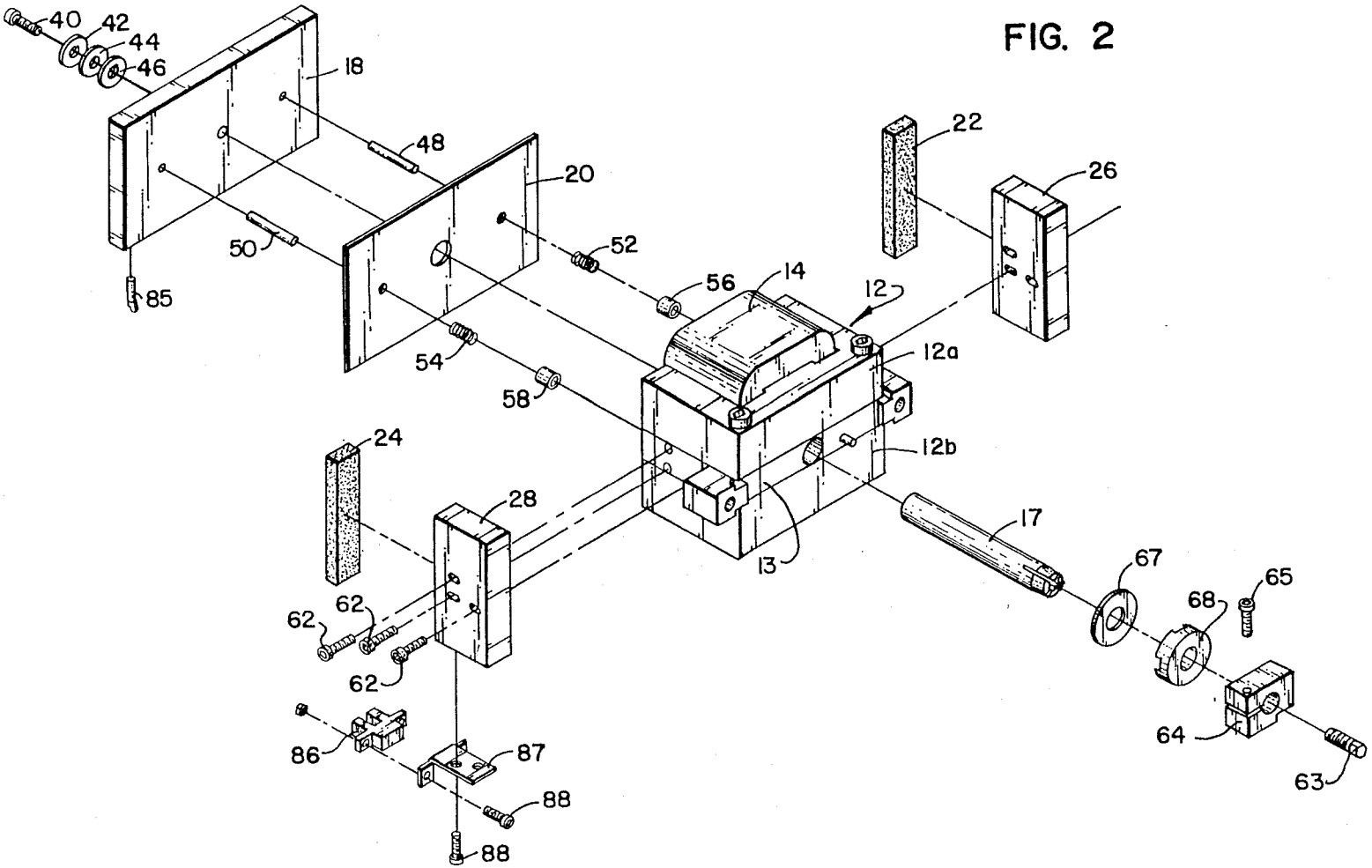
FIG. 2 is an exploded perspective view of the solenoid shown in FIG. 1.

Illustrated in FIGS. 1 and 2 is an embodiment of a solenoid 10 including an embodiment of an energy absorbing bumper arrangement 11 in accordance with the principles of the present invention. The solenoid 10 has a body 12. In the preferred embodiment, the nonresilient body 12 is a laminated steel design to minimize eddy currents which heat up the solenoid and slow its operation. Laminations are silicon steel for maximum magnetic flex capacity. As illustrated in FIG. 2, an aluminum center block 13 holds all solenoid parts together but is not part of the magnetic path. The solenoid body 12 has a solenoid coil 14 located therein. In the preferred embodiment, the coil 14 has 466 turns of 25 AWG wire and a one shot thermal fuse epoxy potted in a plastic shell. The coil 14 is coupled to an external power source (not shown) such that a current may be fed into the coil 14, thus activating the solenoid. A solenoid plunger 16 is slidably supported in an inner aperture of the solenoid coil 14 and body 12. The solenoid plunger 16 has a shaft 17 which is slidably positioned in the inner aperture of the solenoid body 12 having an upper and lower portion 12*a*,12*b* and the solenoid coil 14. The solenoid shaft 17 is preferably comprised of nonmagnetic stainless steel. The solenoid shaft 17 rides in two rulon bearings pressed into the center block (not shown). The solenoid plunger 16 further has a head portion 19 which includes a plain carbon steel plate 18 bolted to the end of the shaft 17. The solenoid plunger plate 18 cooperates with the solenoid body portions 12*a*,*b* to form a magnetic path as illustrated by arrows 9 in FIG. 1. Although shown in one direction, the direction of the magnetic path is not important. In the embodiment shown, the magnetic path of the plunger 16 is near saturation when the coil 14 has 5 amps of current applied to it. In the preferred embodiment shown, a 0.02 centimeter thick nonmagnetic stainless steel shim 20 is fastened to the plunger plate 18 between the plate 18 and the shaft 17. The shim 20 provides a gap in the magnetic path between the plate 18 and body 12 so they do not stick together from residual magnetism.

Two shock-absorbing compliant bumpers 22 and 24 are mounted to bumper supports 26 and 28, respectively. Bumper supports 26 and 28 are in turn mounted to the center aluminum block 13 as shown in FIG. 2. The shock-absorbing bumpers 22 and 24 absorb the impact of the plunger 16 at the end of its forward stroke. The solenoid's forward direction of movement is to the right as indicated by arrow 15 in FIG. 1. This energy-absorption minimizes audible noise and increases solenoid life. The bumpers 22 and 24 are molded from the highly damped thermoplastic material (loss factor is approximately 1.0 at room temperature). Using a highly damped thermoplastic minimizes bounce of the plunger 16 when it contacts the bumpers. Also, the highly damped materials used are stiff at high strain rates and soft at low strain rates.

The bumper arrangement 11 is particularly suited for use with the solenoid design disclosed in Ser. No. 204,499, file June 9, 1988, which has a two phase operation. In the first phase, the solenoid plunger is quickly moved with relatively little force into embossing position proximate the surface of the item to be embossed. In the second phase, the plunger applies much greater force sufficient to cause embossing of the card. During the second phase, the plunger moves very little; i.e., the embossing depth of the characters on the card. Due to the use of a highly damped material, the bumper arrangement of the present invention provides a high resistance to the plunger 16 when it first comes in at high speed during the first phase, yet low resistance to the plunger 16 when a character is being embossed, as in the second phase. Moreover, the plunger plate 18 engages the solenoid body 12 at the end of the embossing phase so as to have a predetermined, repeatable stop location.

The bumpers of the present invention are not limited to high damped thermoplastic materials, but may be comprised of any material providing the correct stiffness, size and geometry required for the particular use. Other shock absorbing apparatuses and methods in keeping with the principles of the present invention might be used; e.g., springs, etc. The position of the bumpers 22 and 24 and supports 26 and 28 are located radially outward from the body 12. The bumpers 22 and 24 are thus removed from the magnetic path of the solenoid 10 so as to not increase the effective magnetic gap between the plunger head portion 19 and the solenoid body 12. Also, this location prevents interference with the magnetic field created by the solenoid. Reduced interference provides for more accurate control of plunger travel.

The bumpers 22 and 24 thus act as shock-absorbing means to absorb the impact of the plunger at the end of its forward stroke during the first phase. As can be seen from FIG. 1, the bumpers 22 and 24 extend a fractional distance beyond solenoid body 12. When the solenoid shaft 17 is moving in the direction of arrow 15, the shim 20 contacts bumpers 22 and 24 initially. As bumpers 22 and 24 absorb the kinetic energy of the solenoid plunger 16, the bumpers compress and allow the solenoid plunger 16 to come to rest against solenoid body 12 at end faces 23 and 25 which extend beyond the coil 14.

FIG. 2 illustrates in more detail an exploded view of the solenoid shown in FIG. 1. A bolt 40 extends through washers 42, 44 and 46 to fasten the solenoid plunger plate 18 and the shim 20 to the solenoid shaft 17. The bolt 40 is fastened to the end of solenoid shaft 17 which is internally threaded to receive the bolt 40. (It will be appreciated that, although shown moving in a horizontal direction, the solenoid plunger 16 may move in a vertical direction with respect to the solenoid body 12.) Pins 48 and 50 are press fitted into apertures in the plunger plate 18 and the shim 20 and are slidably disposed in corresponding apertures (not shown) in the solenoid body 12. The pins 48 and 50 are slidably received by springs 52 and 54 and bearings 56 and 58 which are positioned in the corresponding apertures of the solenoid body 12. The pins 48 and 50 prevent rotation of the plunger plate 18. Springs 52 and 54 act as a biasing means to help separate shim 20 and plate 18 from solenoid body 12 when the solenoid 10 is in its resting position prior to the next embossing cycle. When the solenoid 10 is in its resting position, the spring 52 and 54 project beyond the solenoid body, whereas when the solenoid is embossing a character, the springs 52 and 54 are compressed into the apertures of the solenoid body 12 so as to allow the plunger to engage the solenoid body 12. Although not shown, in use the nonresilient solenoid body is secured against movement.

The bumper support 28 is suitably secured to the center block 13 by threaded fasteners 62 (although not shown, bumper support 26 is similarly attached). The center block 13 may be made of aluminum so as not to interfere with the magnetic path of the solenoid. Other nonmagnetic materials may also be used to construct the center block 13. The resilient bumpers 22 and 24 may be secured to bumper support mounts 26 and 28 by any securing means, more particularly, a strong adhesive capable of coupling a thermoplastic material to an aluminum support. The solenoid shaft 17 extends through the solenoid body 12 and is suitably fitted with a high strength steel hammer 63 proximate its end. In the embossing application, it is the hammer 63 which strikes the character emboss elements 71 (punch and die). In the embodiment shown, the hammer 63 is threaded into the plunger shaft 17 a specified distance to adjust emboss height and card bow. It has a 10–32 thread and hex end so 1/6 of a revolution corresponds to 0.013 centimeters of hammer adjustment.

The hammer 63, in an embossing system, contacts character emboss elements 71 (punch and die) which are slidably disposed about the circumference of two rotatable character wheels 70, one of the wheels 70 housing the punch elements and the other the die elements. The hammer 63 drives a specific character emboss element 71 into the surface of a card 80 or other embossing substrate. The wheels 70 rotate to align the desired character emboss elements 71 (punch and die) between the hammer 63 and the embossing substrate 80. The hammer 63 is also preferably chamfered on its character end to minimize catching of the character emboss elements 71 if the wheel 70 moves when the solenoid shaft 17 is not fully retracted.

A shaft clamp 64 and threaded screw 65 fixes hammer 63 to the shaft 17. A washer 67 and damping washer 68 are provided on the plunger shaft 17 to absorb impact and prevent rebound from the return stroke. Washer 68 is typically molded from highly damped thermoplastic which retains its damping qualities (loss factor is approximately 1.0) over the temperature range of the solenoid (20° C. to 60° C.).

In the preferred embodiment shown, a flag member 85 is suitably attached to the solenoid plunger plate 18. A photocell sensor 86 is suitably mounted onto the bumper support 28 by a mounting plate 87 and threaded fasteners 88. The sensor 86 and the flag 85 cooperate to sense when the plunger head portion 19 has moved into close proximity to the faces 23 and 25. The sensor arrangement can thus be used to detect if in fact the plunger head portion 19 has moved into the solenoid body 12 to emboss a given character and whether the plunger end portion 19 has moved away from the solenoid body 12 once character embossing is completed for a given character or has become stuck to the solenoid body 12.

The above has been a detailed description of a preferred embodiment of the present invention. It will be appreciated that numerous variations can be made in this detail and still be in keeping with the principles of the present invention.

Figure 4:
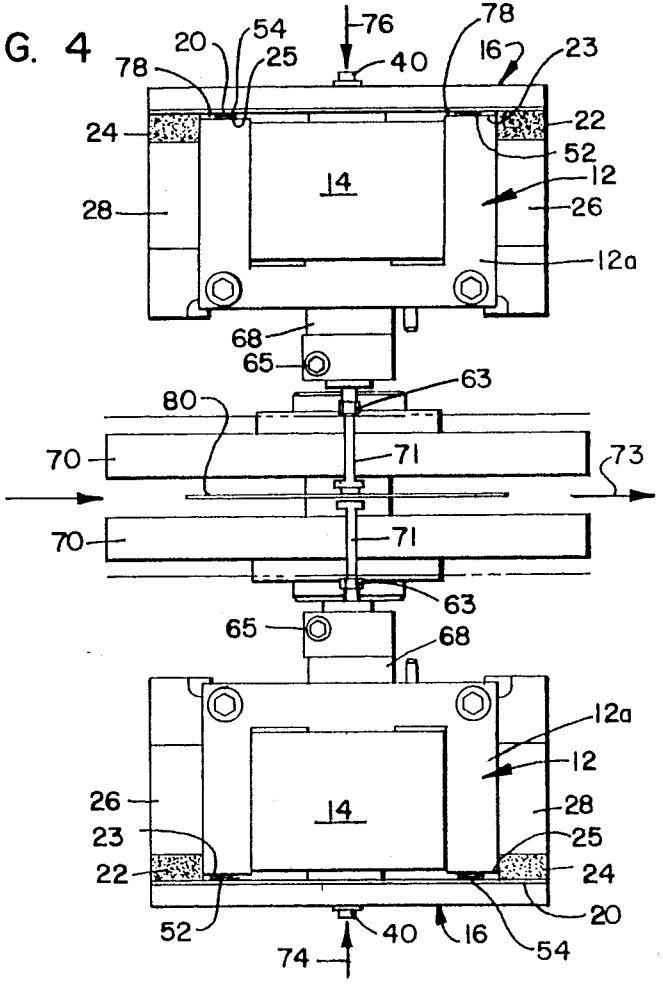
FIG. 4 is a view similar to FIG. 1, the solenoid shafts being in close approximation to the surface of a card to be embossed.
Figure 3:
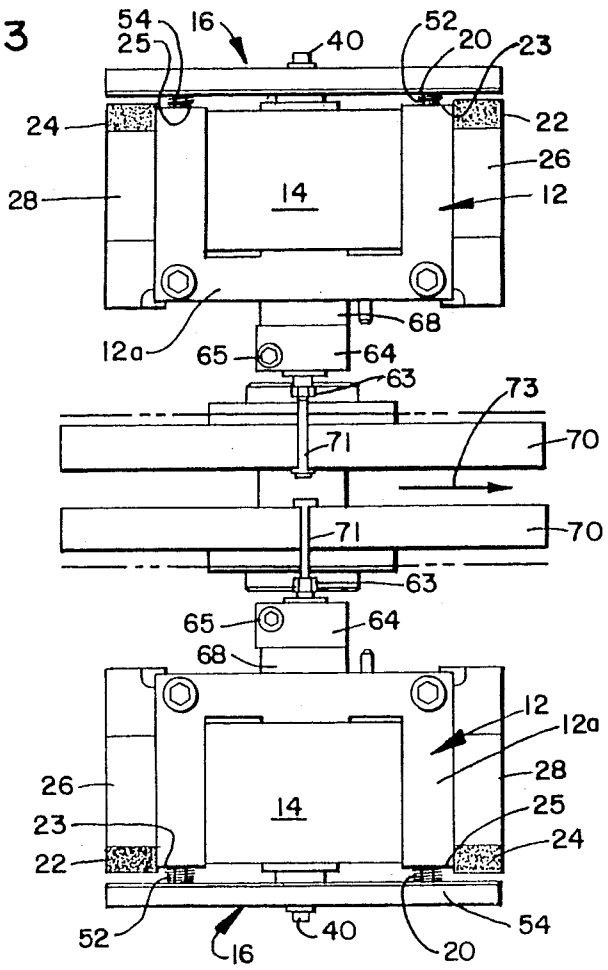
FIG. 3 is a diagrammatic top view of a two solenoid embosser using the solenoid shown in FIG. 1, the embosser being at the beginning of its emboss cycle.
Figure 5:
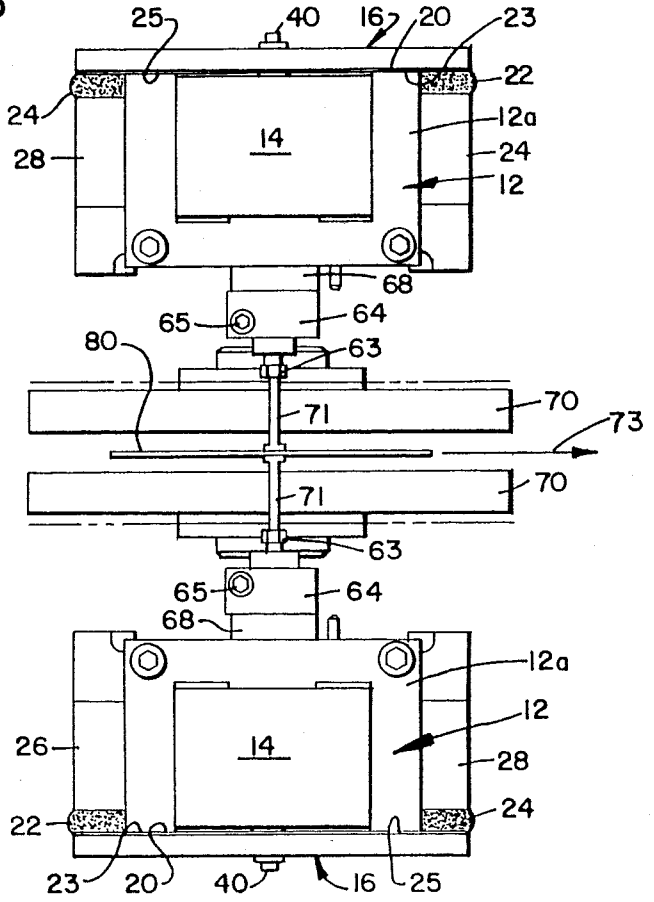
FIG. 5 is a view similar to FIG. 1, the embosser embossing the card.

FIGS. 3, 4 and 5 illustrate the operation of solenoids 10 as used in an embosser device. Two solenoids 10 are positioned opposing each other on opposite sides of a card transfer path 73. In FIG. 3, plungers 16 are shown in their starting position, when the gap between the plunger plates 18 and the solenoid bodies 12 are at their maximum. The bumpers 22 and 24 are shown extending beyond solenoid body faces 23 and 25, respectively. The distance that the bumpers 22 and 24 extend beyond faces 23 and 25 vary with the strength of the solenoids and the material used as bumpers 22 and 24.

FIG. 4 illustrates the position of plungers 16 and hammers 63 as shafts 17 begin to move in the direction of arrows 74 and 76. The shims 20 are shown in contact with bumpers 22 and 24. A small gap 78 is visible between the shims 20 and faces 23 and 25. The gaps 78 are the distance plunger 16 must travel before contacting faces 23 and 25 of the solenoid bodies 12.

FIG. 5 illustrates the solenoids 10 at the end of their embossing mode of the embossing cycle. Shims 20 are in contact with faces 23 and 25. Bumpers 22 and 24 are compressed such that a small bulge may be seen on the perimeter. The plungers 18 may not travel toward body 12 any further due to opposing faces 23 and 25. Thus, it is evident that repeatable precision is imparted to the distance of travel of shaft 17. The distance of travel of plunger 16 is identical for every cycle of the solenoid. It is not dependent on the strength of a bumper or other variables. Character emboss elements 71 fully compressed create an embossed character in the embossing substrate 80. The precision of the distance moved by shaft 17 is required in the embossing art. If the hammer 63 extends too far in the direction of the embossing substrate 80, the resulting character might be too high or the character emboss elements 71 may push entirely through the embossing substrate 80. If the hammer 63 does not extend far enough, the character may not be sufficiently formed. After the substrate 80 is embossed, the solenoid plungers 16 are returned to the position as shown in FIG. 3.

Figure 6:
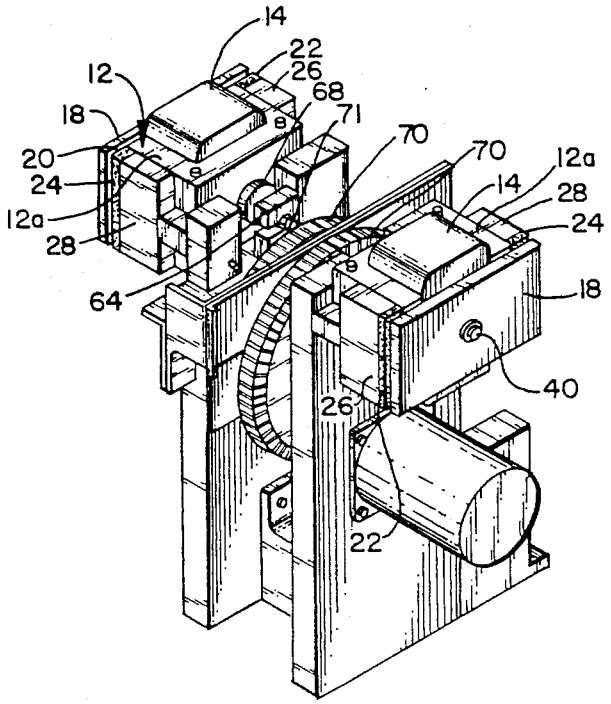
FIG. 6 is a partial perspective view of the embosser shown in FIGS. 3–5 using the solenoid and bumper arrangement shown in FIG. 1.

FIG. 6 is a perspective view of the solenoid 10 being used in an embosser. Character wheels 70 are visible between solenoid mechanisms 10. The embossing substrate 80 is positioned between wheels 70 such that the hammers 63 engage corresponding character emboss elements 71 of the wheels 70 and drive the character emboss elements 71 into the embossing substrate 80. The complete cycle of this embossing system may be seen in FIGS. 3, 4 and 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An energy-absorbing bumper arrangement used with solenoids having a solenoid body and plunger, the plunger being coaxially movable away and toward the solenoid body and comprising a head portion and a shaft portion projecting into the solenoid body, the solenoid being a magnetic field with a magnetic path extending between the solenoid body and the plunger head portion, the spacing between the solenoid body and the plunger head portion forcing an effective magnetic gap whose size affects the force with which the plunger is moved toward the solenoid body, the bumper arrangement comprising:

(a) substantially nonresilient stop means for stopping movement of a plunger at a repeatable, predetermined location; and (b) energy-absorbing means for reducing impact force of the plunger striking the stop means, energy-absorbing means comprising a resilient member removed from the magnetic path of the solenoid body so as to not increase the effective magnetic gap, and projecting beyond the stop means in a direction facing the plunger head portion, so that as the plunger moves toward the stop means, the plunger impacts the energy-absorbing means and transfers energy to the energy-absorbing means, the energy-absorbing means providing less resistance than required to stop movement of plunger toward the stop means, thereby allowing the plunger to strike the stop means and stop at a repeatable, predetermine location.

2. A bumper arrangement in accordance with claim 1, wherein the stop means comprises a first end of the solenoid body facing the plunger-head portion and wherein the energy-absorbing means includes a resilient member mounted on the solenoid body immediately removed from the magnetic field an projecting beyond the first end of the solenoid toward the plunger head portion.

3. The bumper arrangement in accordance with claim 1, wherein the solenoid and bumper arrangement are utilized in an embossing system for embossing card-like members with characters.

4. The bumper arrangement in accordance with claim 3, wherein the plunger of the embossing system having a range of travel with a plus or minus variance from 0.01 inches to 0.3 inches.

5. An energy-absorbing bumper arrangement used with a solenoid having a solenoid body and a plunger, the plunger being coaxially movable away and toward the solenoid body and comprising a head portion and a shaft portion projecting into the solenoid body, the solenoid body having oppositely facing first and second ends, the first end facing the plunger head portion, the solenoid being a magnetic field with a magnetic path extending between the solenoid body and the plunger head portion, the spacing between the solenoid body and the plunger head portion forcing an effective magnetic gap whose size affects the force with which the plunger is moved toward the solenoid body, the bumper arrangement comprising:

(a) an energy-absorbing means for reducing impact force of the plunger head portion striking the first end of the solenoid body, the energy-absorbing means comprising a resilient member removed from the magnetic path of the solenoid body so as to not increase the effective magnetic gap and projecting slightly beyond the first end of the solenoid body toward the plunger head portion so that as the plunger moves toward the solenoid body, the plunger head portion impacts the energy-absorbing means and transfers energy to the energy-absorbing means, the energy-absorbing means providing less resistance than required to stop movement of the plunger head portion toward the first end of the solenoid body, thereby allowing the plunger head portion to strike the first end of the body such that the plunger head portion stops at a repeatable, predetermined location on each movement toward the solenoid body; and (b) means for mounting the resilient member on the solenoid body.

6. The bumper arrangement in accordance with claim 5, wherein the resilient member is mounted on an outside wall of the solenoid.

7. A bumper arrangement in accordance with claim 5, wherein the resilient member is molded from a highly damped thermoplastic with a loss factor of substantially 1 at room temperature.

8. A bumper arrangement in accordance with claim 5, wherein the resilient member is located outwardly from the magnetic field of the solenoid.

9. A bumper arrangement in accordance with claim 5, wherein the plunger head portion engages the energy-absorbing bumper means at a greater rate of speed than the plunger head portion engages the first end of the solenoid body.

10. A bumper arrangement in accordance with claim 5, wherein the first end of the solenoid body is substantially flat.

11. A bumper arrangement in accordance with claim 5, wherein the resilient member provides high resistance to plunger movement at high speeds and less resistance to plunger movement at low speeds.

12. A method for reducing noise of a solenoid and stopping the plunger at a predetermined, repeatable location, solenoid being of the type including a solenoid body and the plunger coaxially movable away and toward the solenoid body and comprising a head portion and a shaft portion projecting into the solenoid body, the solenoid being a magnetic field with a magnetic path extending between the solenoid body and the plunger head portion, the spacing between the solenoid body and the plunger head portion forcing an effective magnetic gap whose size affects the force with which the plunger is moved toward the solenoid body, the method comprising the steps of:

(a) stopping movement of the plunger at a predetermined, repeatable location; and (b) engaging the plunger with a resilient member at a location removed from the magnetic path of the solenoid and prior to stopping the plunger movement.

* * * * *

UNITED STATES PATENT AND TRADEMARK OFFICE

CERTIFICATE OF CORRECTION

PATENT NO. : 4,862,127

DATED : August 29, 1989

INVENTOR(S) : Lundstrom et al.

It is certified that error appears in the above-identified patent and that said Letters Patent is hereby corrected as shown below:

Col. 1, line 8, "lunger" should be --plunger--.

Col. 3, line 52, "file" should be --filed--.

Col. 6, line 67, after "of" insert --the--.

Col. 7, line 2, "predetermine" should be --predetermined--.

Signed and Sealed this

Tenth Day of December, 1991

*Attest:*

HARRY F. MANBECK, JR.

*Attesting Officer*

*Commissioner of Patents and Trademarks*